US005528912A

United States Patent [19]

Weber

[11] Patent Number: 5,528,912

[45] Date of Patent: Jun. 25, 1996

[54] AUTOMATIC AND TRAVEL STEAMER

[76] Inventor: Barry J. Weber, 402 Bob-O-Link, Bloomingdale, Ill. 60108

[21] Appl. No.: 516,652

[22] Filed: Aug. 18, 1995

[51] Int. Cl.[6] ..... D06B 5/24

[52] U.S. Cl. ..... 68/6; 34/622; 68/222; 223/51

[58] Field of Search ..... 68/5 C, 6, 222; 34/622; 223/51, 70, 73, 76

[56] References Cited

U.S. PATENT DOCUMENTS

| | | | |
|---|---|---|---|
| 2,975,529 | 3/1961 | Weber | 223/51 X |
| 3,264,755 | 8/1966 | Moore | 34/622 |
| 3,594,917 | 7/1971 | Montgomery | 223/51 X |
| 3,601,292 | 8/1971 | Bliss | 68/6 |
| 4,572,364 | 2/1986 | Jordan | 34/622 X |

*Primary Examiner*—Philip R. Coe

[57] ABSTRACT

The present invention is a device that automatically removes wrinkles from clothing, either at home or while traveling. It requires a minimum of effort to assemble, use or dismantle and can be packed for travel in a small, lightweight case. Clothing is placed in a modified "wardrobe" type bag that contains a secured, but removable, hand-held steamer, with an automatic shut-off valve at the bottom. The bag is secured to the top of a doorway or some other spot, the clothes are hung inside the bag at the top, and the door is zippered shut. The switch is then turned on and left on. When the cycle is complete, an automatic shut-off switch turns the steamer and an indicator light off. The clothes may then be removed for drying. When the device is no longer needed to be in use, or in preparation for travel, it can be collapsed and folded into a space that is about 1/10 of a cubic foot.

1 Claim, 1 Drawing Sheet

AUTOMATIC AND TRAVEL STEAMER

BACKGROUND OF THE INVENTION

A. Field of the Invention

The device described below allows travelers and those at home a quick and easy way to remove wrinkles from clothing, for a fresh pressed look, without expenditure of personal effort and little use of personal time.

B. Description of Prior Art

The only devices currently on the market to assist a person in removing wrinkles from their clothing, especially when they are traveling are a traveling iron or a traveling clothes steamer. Both of these devices take considerable amount of time, and in some cases skill, by the person using the device. Alternatives involve the expensive use of hotel cleaning services or even the expense of professional cleaners at home. The Automatic and Travel Steamer allows a person to prepare a number of articles of clothing at once, without standing beside each article of clothing with a hot steamer or iron while the processing is completed. Furthermore, with the use of this device, it is exceedingly easy to travel light, as a few ensembles of clothing will suffice in most cases. At home, clothing life can be extended and pressing expenses reduced through the regular use of the item.

SUMMARY OF THE INVENTION

The present invention consists of a collapsible "wardrobe" like bag with foldable hard plastic ribbing to expand the bag to its working size. The top plastic ribbing will have a place for the anchoring of small chains, which will be attached to a large clamp that can be mounted to the top of a doorway, or other convenient location. The bottom ribbing will contain a middle spot where a lightweight steamer, with automatic shut-off valve and folding handle can be securely mounted. Six dress shirts or four suit coats or dresses or similar combinations of clothing may be placed inside. The filled steamer then may be turned on, the bag door zipped shut, and the owner may go on to do other activities. In about 40 minutes, the steamer will shut off. After the clothes are removed, they will require from 20 minutes to one hour to dry, depending upon the conditions for drying. The owner has the option to use the steamer in a hand-held fashion for spot touch up, although that is seldom, if ever needed.

When the apparatus is completed, it can be packed and folded, in its entirety, into a space that is 4"×8"×12," weighing less than 4½ lbs.

Unlike conventional hand-held steamers or irons, this device does not require the on the spot attention of the owner, while the clothes are being prepared. Although a minimal amount of time is required for set-up and take-down, these times are considerably less than what an average person would spend with just one clothing item. Furthermore, when in use, the Automatic and Travel Steamer is able to ready a number of articles of clothing for use in the same time. Drying time may be slightly longer, but not if an open window or fan is available.

BRIEF DESCRIPTION OF THE DRAWINGS

The above and other objects and advantages of the invention will become apparent from the following detailed description of a preferred embodiment of the invention illustrated in the accompanying drawings wherein.

DETAILED DESCRIPTION OF THE PREFERRED EMBODIMENT

Figure 1:
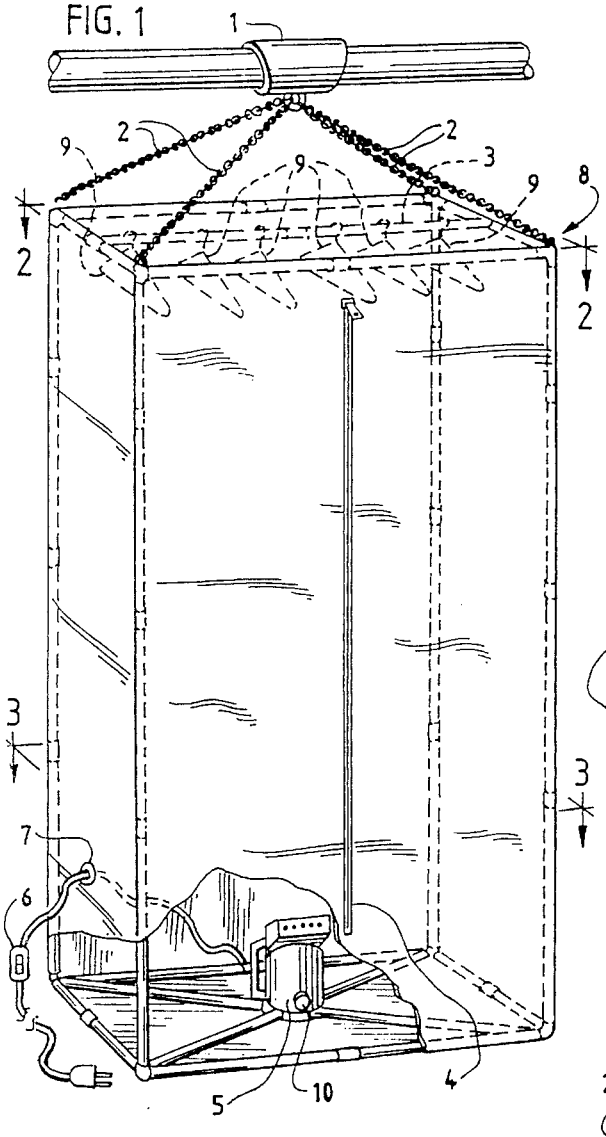
FIG. 1 illustrates the device fully assembled and ready for use.

FIG. 1 shows the device assembled and ready for use. It hangs from a clamp 1 that is shown mounted on the top of a doorway. Four small chains 2 connect to a loop suspending from the clamp to fasten to each corner of the bag 8 which actually has a small opening allowing the chains to connect to the corners of the top ribs 11–14. Telescoping rod 3 is used for hanging the clothing on hangers 9. Note the hole 7 in the side of the bag 8 that allows for the steamer cord to leave the bag. Switch 6 for the steamer 5 is approximately 12 inches from the side of the bag. When the clothes are in place, the zipper 4 is closed all the way up, the switch 6 is turned on and the clothes are automatically steamed. When the water is exhausted in the steamer 5, the automatic shut-off switch 6 is activated and the service light 10 goes out, indicating the cycle is complete. The clothes may then be removed for air drying.

Figure 2:
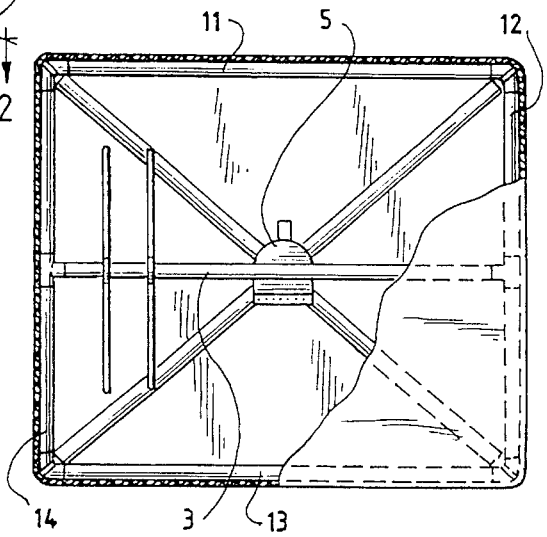
FIG. 2 illustrates details on the top ribbing.

FIG. 2 is a detail of the top ribbings 3 and 11–14 all of which have their numbers stamped on them supporting the bag and the clothing. Note that there are snaps for connecting the end of each rib with another and that ribs 12 and 14 also contain snaps for securing rib 3.

Figure 3:
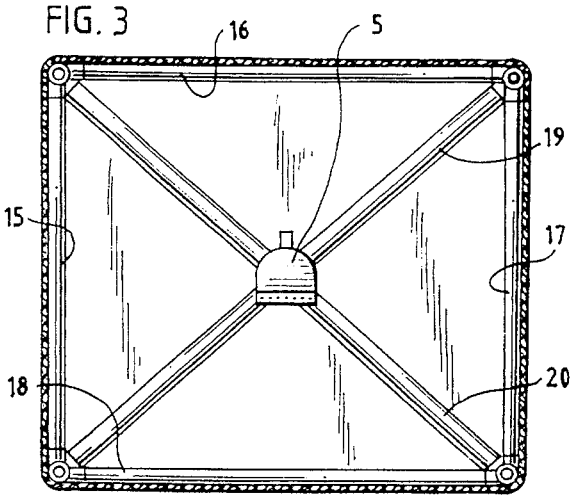
FIG. 3 illustrates details on the bottom ribbing.

FIG. 3 is a detail of the bottom ribbings 15–20 with their numbers stamped upon them which also shows how the steamer 5 is mounted. The grooves allow the bottom ribs 19 and 20 to snap into the bottom of the steamer 5.

Figure 4:
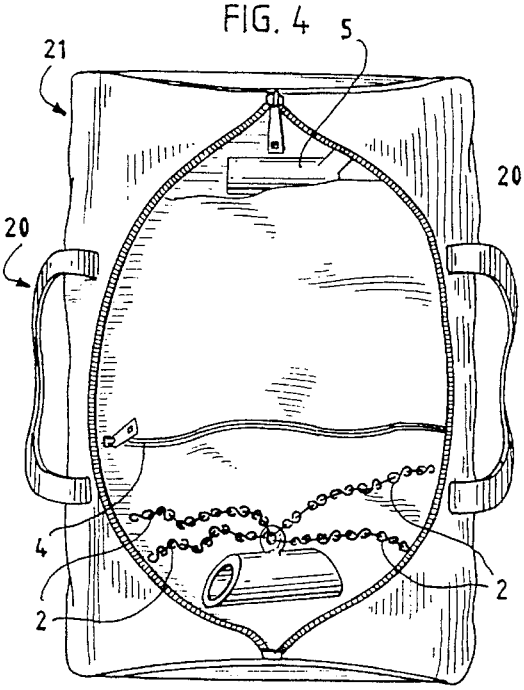
FIG. 4 illustrates the device packed and ready to transport.

FIG. 4 shows the preferred placement of all of the parts of the automatic steamer 5 in its travel carrier 21. The ribs 3 and 11–14 are all placed on the padded bottom of the case. The wardrobe bag 8 is placed in next, followed by the steamer 5 on its side with its handle folded into its body and the cord wrapped up at the bottom. The claim 1 and its chains 2 simply sit on top of the wardrobe bag. When the bag is packed, it can be zipped shut and has handles 21 for carrying separately, if desired.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

I claim:

1. A lightweight, portable travel steamer for simultaneously steaming wrinkles out of several articles of clothing, comprising:

a wardrobe bag of easily foldable, lightweight material and having four corners, a clamp for attachment to a top of a doorway, lightweight chains for removably connecting each corner of said wardrobe bag to said clamp for hanging said wardrobe bag from a top of a doorway, a telescoping rod for removably mounting in said wardrobe bag and for hanging thereon several articles of clothing to be steamed, a portable steamer for placing in said wardrobe bag, a plurality of ribbing members for providing a frame for said wardrobe bag, and a travel carrier for holding and carrying said wardrobe bag, said clamp, said chains, said telescoping rod, said portable steamer, and said ribbing members.

* * * * *